United States Patent [19]

Ptinis

[11] 4,210,321

[45] Jul. 1, 1980

[54] MAGICAL-TYPE GAME

[76] Inventor: Athanasios N. Ptinis, 7747 Stewart Ave., Montreal, Quebec, Canada

[21] Appl. No.: 952,728

[22] Filed: Oct. 19, 1978

[51] Int. Cl.[2] ..... A63J 21/00

[52] U.S. Cl. ..... 272/8 N

[58] Field of Search ..... 272/8 R, 8 D, 8 N, 8 M, 272/8 F, 8 P, 27 R, 27 B, 27 N, 27 W; 248/346.1

[56] References Cited

U.S. PATENT DOCUMENTS

| | | | |
|---|---|---|---|
| 565,254 | 8/1896 | Baer | 272/8 N |
| 787,535 | 4/1905 | McGrath | 272/8 N |
| 2,199,818 | 5/1940 | Franke | 272/8 N |
| 3,120,077 | 2/1964 | Stoffel | 248/346.1 |

*Primary Examiner*—Richard C. Pinkham

*Assistant Examiner*—Arnold W. Kramer

[57] ABSTRACT

A magical-type game to create a vanishing illusion of an article. The game comprises a background element having a plain outer surface of uniform color. An article of contrasting color is disposed on the background element. A displaceable member is movable within the boundaries of the background element and has an article covering portion which is at least as large as the article whereby to mask this article when the displaceable member is positioned thereover. The article covering portion has a front surface of substantially identical uniform color as the background element. A cover is also provided of contrasting color to the background element and is configured to be removably positioned over the displaceable member to fully cover the article covering portion thereof.

5 Claims, 2 Drawing Figures

MAGICAL-TYPE GAME

BACKGROUND OF INVENTION (a) Field of the Invention

The present invention relates to a game to create a vanishing illusion of an article which is positioned on a plain background having a uniform color.

(b) Description of Prior Art

Various types of games have been provided to cover elements, such as coins, whereby to create an illusion that such elements have disappeared or have shifted position relative to an initial position. The present invention relates to such a game which is of very simple construction.

SUMMARY OF INVENTION

According to a feature of the present invention there is provided a game to create a vanishing illusion of an article, which game is very economical to produce and easy to use by people of all ages.

A further feature of the present invention is to provide a game to create a vanishing illusion of a coin by positioning a ring member having a cover thereon over the coin and thereafter removing the cover member.

According to the above features, from a broad aspect, the present invention provides a game to create a vanishing illusion of an article. The game comprises a background element having a plain outer surface of uniform color. An article of contrasting color is disposed on the background element. A displaceable member is movable within the boundaries of the background element and has an article covering portion which is at least as large as the article whereby to mask this article when the displaceable member is positioned thereover. The article covering portion has a front surface of substantially identical uniform color as the background element. A cover is also provided of contrasting color to the background element and is configured to be removably positioned over the displaceable member to fully cover the article covering portion thereof.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
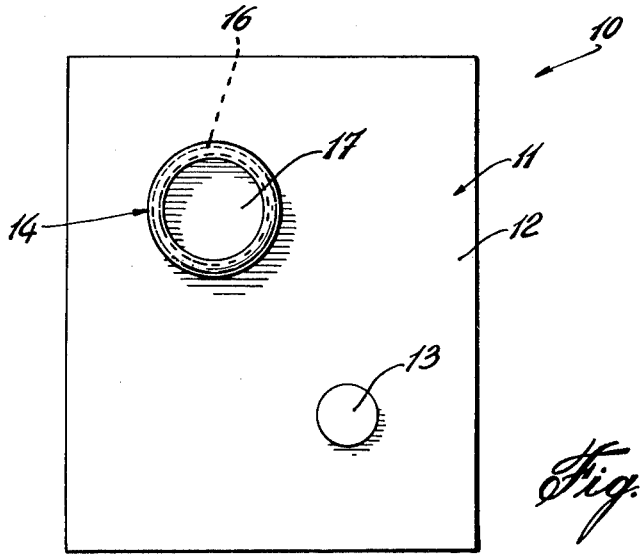
FIG. 1 is a plan view of the game of the present invention.

Referring now to the drawings, there is shown generally at 10 the game of the present invention and which comprises essentially a background element 11, herein a sheet of material such as paper, cardboard, fabric or the like, having a plain outer surface 12 of uniform color. An article 13, herein a coin, is positionable over the background element 11 and is of contrasting color to the outer surface 12 thereof. A displaceable member 14, herein shown as an annular ring 15, is displaceable over the background element 11 and positionable over the coin 13 to create an illusion that the coin has disappeared. This illusion is achieved by the construction of the ring 15 and a cover 16 which is positioned thereover, as described hereinbelow.

Figure 2:
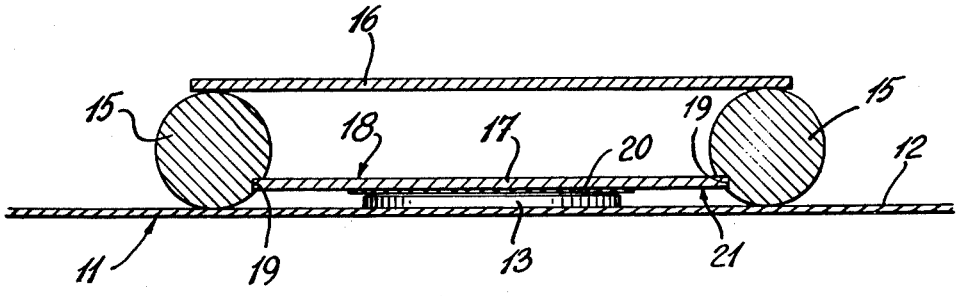
FIG. 2 is a cross-section view showing the construction of the ring member and the position of the cover relative thereto and the orientation of the ring member with respect to the coin article and background element.

Referring now more specifically to FIG. 2, it will be seen that the ring 15 has an article covering portion 17 which is at least as large as the coin 13 whereby to cover the article when the displaceable member is positioned thereover. The article covering portion has a front surface 18 of substantially identical uniform color as the outer surface 12 of the background element 11. The cover 16 is formed of a cardboard disc or disc made of other suitable material such as plastic and is of contrasting color to the outer surface 12 of the background element 11.

Because the article covering portion 17 is of the same color as the outer surface 12 of the background element 11, when the displaceable member 14 is positioned over the background element 11 and one looks at it from a distance, it appears that the ring has a through bore as both the portion 17 of the ring and the outer surface 12 of the background element are of the same color. The cover 16 is then placed over the ring and the ring is then placed over the coin 13. The cover 16 is then removed from the ring and the illusion that the coin 13 has disappeared is created, as a person looking at the ring only sees the outer surface 18 of the article covering portion 17.

As shown in FIG. 2, an annular groove 19 is disposed on an inner circumferential portion of the ring 15 in a lowermost portion thereof. Preferably, the groove 19 and article covering portion 17 are positioned within the ring lowermost of the central plane of the ring passing through the center of the circular cross-section of the ring. Thus, the article covering portion 17 is spaced slightly above the outer surface 12 when the ring is positioned thereon whereby most of the angulated inner periphery of the ring is shown, making it very difficult to see the portion 17. The article covering portion 17 is a diaphragm or disc formed of pliable material and adapted to be snap fitted into the groove 19, whereby the peripheral margin of the disc 17 is captive within the groove 19. The disc 17 could also be glued along its periphery into the groove 19. As herein shown, the ring 15 is formed of a plastics material, as well as the article covering portion 17. The cover 16 is formed of cardboard material. Any other suitable materials may be used for these elements.

In a further modification of the game, a thin magnet 20 may be conveniently secured, such as with glue, on a back surface 21 of the article covering portion or disc 17. The article 13 herein would be a coin-like article made of magnetically attractable material. Thus, when the ring 15 is positioned over the coin-like element 13, it is attracted to the magnet and by removing the cover 16 and displacing the ring, a greater illusion of disappearance is created. The magnet 20 should be of only sufficient magnetic strength whereby the coin may be released on the surface 12 by lifting the ring 15 slightly and tapping the outer surface 18 of the article covering portion 17 with the finger to impart a shock to the magnet to cause the article 13 to fall by gravity as the ring is lifted off the surface 12.

Although in FIG. 1 the displaceable element 14 is shown as a ring 15, it may also be of any other suitable shape. Also, the cover 16 may likewise be of other suitable shape. As herein shown, the cover is circular and of larger diameter than the article covering portion 17 and smaller diameter than the outer periphery of the ring, whereby a portion of the ring is still shown when the cover 16 is positioned thereover. The ring is, of course, of contrasting color to the background element 11.

It is within the ambit of the present invention to cover any further obvious modifications thereof, provided these fall within the scope of the appended claims.

I claim:

1. A game to create a vanishing illusion of an article, said game comprising a background element having a plain outer surface of uniform color, an article of contrasting color disposable on said background element, a displaceable ring member having a bore and movable within the boundaries of said background element ,said ring further having a diaphragm secured across said circular bore in an annular groove disposed on an inner circumferential portion of said ring member lowermost of the central plane of said ring passing through the center of the circular cross-section of said ring, and spaced from the outer lower plane of said ring whereby an angulated inner periphery of the ring is visible from above the ring below said central plane having a front surface of substantially identical uniform color as said background element, and a cover of contrasting color to said background element and configured to be removably positioned on said displaceable member to fully cover said diaphragm.

2. A game as claimed in claim 1 wherein a magnet is secured on a back surface of said disc, said article of contrasting color being of a magnetically attractable material.

3. A game as claimed in claim 1 wherein said article of contrasting color is a coin.

4. A game as claimed in claim 1 wherein said background element is a sheet of paper-like material.

5. A game as claimed in claim 1 wherein said cover is a circular disc having a diameter larger than said circular bore and smaller than the outer diameter of said ring member and being of contrasting color to said background element.

* * * * *